US006047518A

United States Patent [19]

Lytle

[11] Patent Number: 6,047,518

[45] Date of Patent: Apr. 11, 2000

[54] METHOD AND APPARATUS FOR INSTALLING BLOWN-IN-PLACE INSULATION TO A PRESCRIBED DENSITY

[75] Inventor: Clifton E. Lytle, Oklahoma City, Okla.

[73] Assignee: Guardian Fiberglass, Inc., Albion, Mich.

[21] Appl. No.: 09/144,625

[22] Filed: Aug. 31, 1998

[51] Int. Cl.[7] ..... E04B 1/74; E04G 21/00

[52] U.S. Cl. ..... 52/742.13; 52/309.5; 52/745.09; 73/32 R; 73/864.51; 156/78; 206/557

[58] Field of Search ..... 52/309.5, 309.7, 52/309.16, 404.1, 742.13, 742.14, 745.09; 73/32 R, 433, 863, 864.51; 156/71, 78; 206/485, 493, 557; 239/9

[56] References Cited

U.S. PATENT DOCUMENTS

| | | |
|---|---|---|
| 1,888,841 | 11/1932 | Wenzel et al. . |
| 3,619,437 | 11/1971 | McDonald, Jr. . |
| 4,134,242 | 1/1979 | Musz et al. . |
| 4,177,618 | 12/1979 | Felter . |
| 4,272,935 | 6/1981 | Lukas et al. . |
| 4,310,996 | 1/1982 | Mulvey et al. . |
| 4,468,336 | 8/1984 | Smith . |
| 4,487,365 | 12/1984 | Sperber . |
| 4,648,920 | 3/1987 | Sperber . |
| 4,673,594 | 6/1987 | Smith . |
| 4,708,978 | 11/1987 | Rodgers . |
| 4,710,309 | 12/1987 | Miller . |
| 4,712,347 | 12/1987 | Sperber . |
| 4,718,289 | 1/1988 | Barrett ..... 73/864.51 X |
| 4,741,777 | 5/1988 | Williams et al. . |
| 4,768,710 | 9/1988 | Sperber . |
| 4,773,690 | 9/1988 | Vincelli et al. . |
| 4,804,695 | 2/1989 | Horton . |
| 4,822,679 | 4/1989 | Cerdan-Diaz et al. . |
| 4,842,650 | 6/1989 | Blounts . |
| 5,085,897 | 2/1992 | Luckanuck . |
| 5,118,751 | 6/1992 | Schulze et al. . |
| 5,131,590 | 7/1992 | Sperber . |
| 5,155,964 | 10/1992 | Fortin et al. . |
| 5,171,802 | 12/1992 | Salazar . |
| 5,287,674 | 2/1994 | Sperber . |
| 5,389,167 | 2/1995 | Sperber . |
| 5,393,794 | 2/1995 | Sperber . |
| 5,421,922 | 6/1995 | Sperber . |
| 5,426,163 | 6/1995 | Buehler et al. . |
| 5,536,784 | 7/1996 | Mao et al. . |
| 5,641,368 | 6/1997 | Romes et al. . |
| 5,666,780 | 9/1997 | Romes et al. . |

OTHER PUBLICATIONS

"Perfect Fit Fiberglass Insulation, Setting the Standards for New Insulation Quality", Brochure, Jun. 1993.

(List continued on next page.)

*Primary Examiner*—Carl D. Friedman
*Assistant Examiner*—Kevin D. Wilkens
*Attorney, Agent, or Firm*—Hall, Priddy & Myers

[57] ABSTRACT

An accurate method and apparatus for installing blown-in-place insulation to a predetermined density and R-value includes the use of a removable container of known unfilled weight and volume located between wall studs during the blowing operation. By removal of the container after filled, and determining its fill weight by weighing it, the density of the insulation is calculated and correlated, if desired, to R-value. If the calculated density is not acceptable, the container is emptied and is reinserted in the cleaned out cavity between the studs. Appropriate adjustments to one or more operating parameters are made until the desired density through further filling of the container and weighing it is achieved. Once achieved, the space to be filled is filled with blown-in-place insulation using the adjusted parameter values.

20 Claims, 2 Drawing Sheets

OTHER PUBLICATIONS

Brochure UltraFit DS[198] Jan. 1997.
Isolatek CAFCO 400 Brochure Oct. 1994.
Spray–On Energy Seal, Energy Wise, Energy Management Systems, 1990.
Isolatek International Memo to Cafco Contractors, Subject: Cafco 300, Jan. 6, 1995.
Isolatek International Memo to Cafco Contractors, Subject: Four–Hour Rated Wall System, Jan. 6, 1995.
Isolatek International Memo to Cafco Contractors, Subject: New UL Joist Designs, Jan. 4, 1995.
Isolatek International, Material Safety Data Sheet, Dec. 15, 1989.

METHOD AND APPARATUS FOR INSTALLING BLOWN-IN-PLACE INSULATION TO A PRESCRIBED DENSITY

FIELD OF THE INVENTION

This invention relates to a method and apparatus for installing loose fill, blown-in-place fibrous insulation to a prescribed density.

BACKGROUND OF THE INVENTION

In recent years, more and more emphasis has been placed on the use of insulation in dwellings to conserve energy and reduce noise. At the same time, architectural designs have created a multitude of different designs and styles which do not always lend themselves to the use of more classic fiberglass or other fibrous batts (often paperbacked and sold in rolls) of uniform factory created widths, and as such, do not fully fill the space in which the batting is installed. This, in turn, has created a need for a technique of applying fiberglass (or other fibrous) insulation which does not use batts of factory determined dimensions.

While others have heretofore fulfilled this need to a limited extent by developing various blown-in-place insulation techniques, this need was truly met, quite successfully, by the loose-fill, blown-in-place system and technique disclosed in U.S. Pat. Nos. 5,641,368 and 5,666,780, and commercially employed under the trademark ULTRAFIT DS™ by Guardian Fiberglass, Inc. In this patented ULTRAFIT DS™ technique and system, loose-fill fiberglass (or cellulose fiber) and a water activated adhesive is admixed with water as it is being blown into, for example, the space between wall, ceiling or floor studs of a residential home or other dwelling. The fast setting adhesive quickly bonds the fibers in an adhering mat to the stud area, regardless of the area's size or shape, thus effectively achieving a uniform volume of insulation which completely fills the desired area for energy conservation, as well as sound insulation purposes, regardless of its shape or size.

While this ULTRAFIT DS™ system and other known blown-in-place techniques overcame the above-described drawback of incomplete fill inherent in batt/rolls of insulation, one of the advantages of a factory manufactured batt is the ability to maintain quality control at the factory level. This includes, of course, the density and thickness of the product, so important to the achievement of a uniform R-value. Density of fibrous insulation as well as thickness, are, in this respect, well recognized as being directly related to the "R-value" of the insulation. Thus, as is well known, when factory made batt insulation is purchased, for example, to place in a new residential home, it is often purchased by specifying its "R-value" and, due to its factory determined dimensions, can be counted on at the job site using minimal prescribed installing techniques to achieve the required R-value, often specified on the package or backing of the batt itself.

When, on the other hand, a "blown-in-place" technique is employed, this "factory" controlled R-value advantage is lost and thus it is often necessary to also employ with it a technique at the job site for measuring density for assuring that the in-situ mat as formed has the requisite density and thickness, and thus the specified or desired R-value. Since the thickness is generally achievable with smoothing and testing with a needle gauge probe, ease and accuracy of determining density, with reasonable accuracy, becomes the governing factor at the job site in achieving the required R-value (often per contractual obligation).

Heretofore various techniques have been employed to test for density of in situ formed, blown-in-place insulation. For example, in certain known techniques the open wall cavity is first filled with blown-in-place insulation, such as fiberglass or cellulose. Then, a hand held scoop of known volume and weight is used to scoop out some of the insulation that has been blown into the cavity. The scoop, including the scooped out insulation, is then weighed in order to determine the density of the insulation that has been blown into the cavity. By knowing the volume and empty weight of the scoop, and then reweighing the scoop filled with insulation, it is possible to determine the density (wt./vol.) of the insulation that was blown into the cavity. R-value is then determined for the as installed insulation in a known fashion by knowing the thickness of the layer from which the insulation was scooped and by the installer using a chart which has, through testing, pre-correlated thickness and density to R-value. The sample taken, however, is small, may be compressed in the scoop, or may not fully fill the scoop. On this small a scale, moreover, error can be magnified if care is not taken to perform the scooping correctly, or a number of scoops are performed for averaging.

In a somewhat similar technique which seeks to predetermine density prior to actually filling the space to be insulated, a 5 oz. (148 ml) Dixie cup is filled from the blower gun. The cup is tapped gently as it is being filled to remove all air pockets. By knowing the weight of the cup itself and thereafter weighing the filled cup, the density (wt./vol.) is calculated. Again, a chart or other guideline correlating density and thickness to R-value is employed to determine the R-value achieved when the insulation is thereafter blown into its intended final location. Once again, of course, the use of such a small cup can give rise to the potential for resulting inaccuracy in the final product, or multiple testing and averaging must be done to overcome this potential error factor.

In yet another technique known to be used, for example, in Great Britain, a portable wooden closed, but openable, box (e.g. 21"×21"×4") is filled through a small opening in the box by a pressure nozzle which blows insulation into the box until it is shut off by a predetermined back pressure thereby, hopefully, indicating that the box is completely "filled". By knowing the weight of the empty box, its volume and the weight of the presumably "filled" closed box, the density of the insulation therein may be estimated by calculation. As can be seen, the box is closed when filled, is not in place in the wall cavity itself when filled, and its "filled" condition is determined by back pressure (unless opened and inspected, and redone if found not filled). Because the box is not hung in the wall cavity which is filled simultaneously therewith, the test does not necessarily replicate an "in place" wall cavity fill which actually occurs when the wall cavity is eventually filled. The technique is thus subject to inaccuracy, and the need for possible multiple testing if upon opening the box it is found that the box has not filled properly when the back pressure shuts off nozzle flow.

In view of the above, it is apparent that there exists a need in the art for an improved method and corresponding apparatus for installing insulation that is blown into open wall cavities to a prescribed density wherein the improved method and apparatus provide increased accuracy.

SUMMARY OF THE INVENTION

Generally speaking, this invention fulfills the above-identified needs in the art by providing a method of installing at a prescribed density and thickness blown-in-place insulation, the method comprising:

providing a volume of space to be filled with said blown-in-place insulation;

preselecting a density and a thickness of said blown-in-place insulation when formed in situ in said space;

locating within said space a container of known weight and volume;

blowing at a given velocity and from a distance into at least a portion of said space to be filled, which portion of said space has said container located therein, an admixture which includes a fibrous insulation material, a fast setting liquid-activated adhesive and a liquid in an amount sufficient to activate said adhesive, in an amount sufficient to form in said container an in situ amount of insulation which fills said known volume of said container;

removing said container from said space and weighing said container filled with said in situ formed insulation;

determining the density of the in situ formed insulation from the known weight and volume of the container and the as weighed weight of the filled container;

thereafter, if said determined density is not the same as said preselected density, adjusting at least one operating parameter to change the density of the insulation and refilling said container by using the adjusted parameter or parameters; redetermining said density and adjusting said parameter or parameters a sufficient number of times until said preselected density is achieved; and thereafter using said so adjusted parameter or parameters to blow said admixture into said space and fill said space to said preselected thickness without said container being located therein.

In certain preferred embodiments of this invention the method further includes pre-correlating the density and thickness of the as formed blown-in-place insulation with at least one R-value, such that the method first includes selecting the density and thickness to conform to a predetermined R-value.

While the container of known volume and weight may assume many different forms, in certain preferred embodiments of this invention further needs are fulfilled by providing a container useful in the practice of the above method when the space to be filled is the open cavity between spaced first and second wall or floor studs in the wall or floor of a dwelling, the container (i.e. the device) comprising:

four sidewall portions and a rear wall defining a chamber for receiving blown-in-place insulation, said chamber having a predetermined fixed volume and said container having a predetermined weight when empty of insulation; and at least one wedge member, for wedgingly retaining said container between said sidewall portions and a respective stud of the open cavity adjacent thereto.

In certain further embodiments of this invention the container, by volume, is at least 10% of the space in which it is located, to be filled with insulation.

This invention will now be described with respect to certain embodiments thereof, accompanied by certain illustrations wherein:

IN THE DRAWINGS

DETAILED DESCRIPTION OF CERTAIN EMBODIMENTS OF THIS INVENTION

Figure 1:
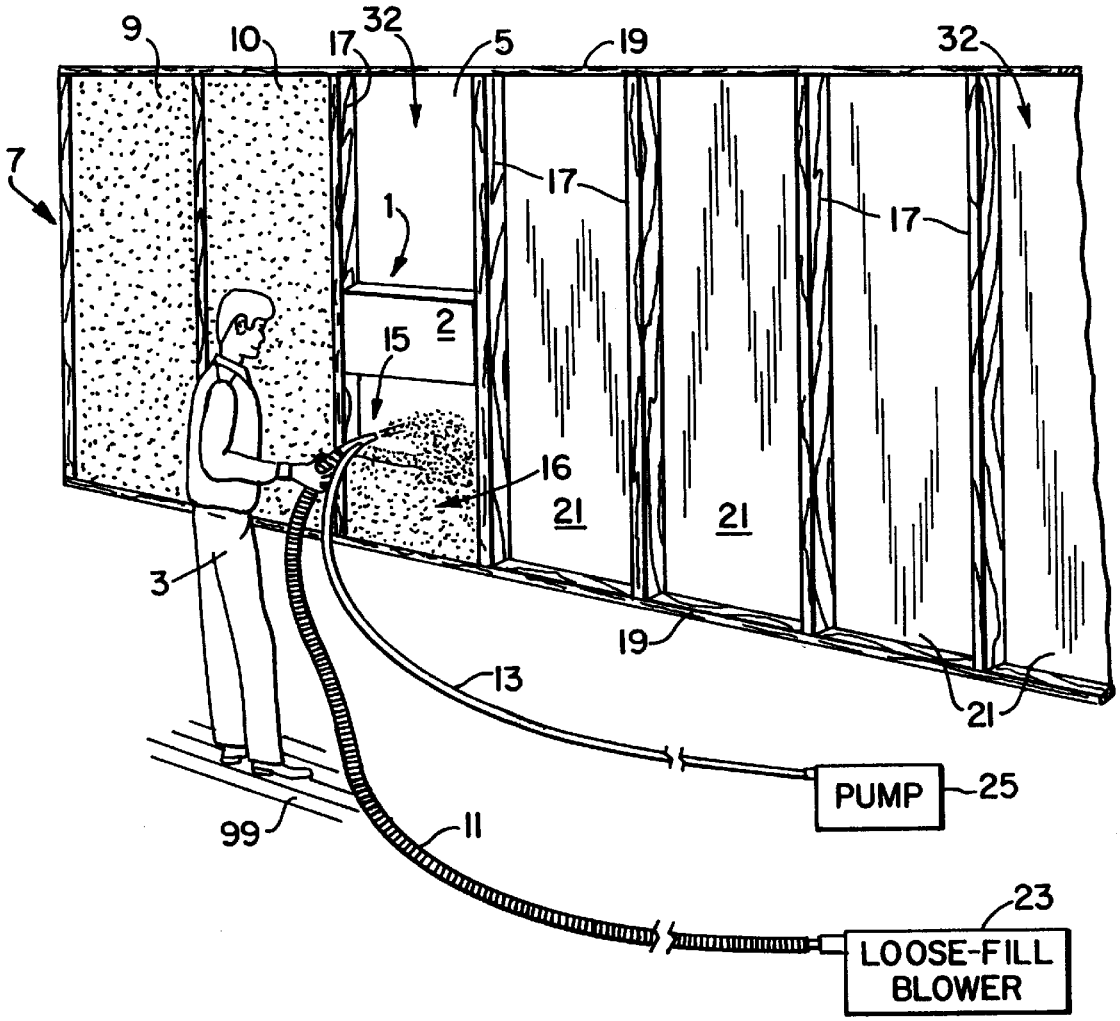
FIG. 1 is a perspective view of a user blowing/spraying a loose-fill fiberglass/dry adhesive mixture coated with an activating liquid, such as water, into a vertically extending open wall cavity including a container of known weight and volume according to an embodiment of this invention.

The term "blown-in-place insulation" is a term well understood in the art and is used herein according to its well known meaning. Generally speaking, "blown-in-place insulation" before it cures in situ, is an admixture formed during the blowing process which comprises a fibrous insulation material (e.g. fiberglass or cellulose fiber), a fast setting liquid activated (e.g. water activated) adhesive usually initially in powder form, and a liquid (usually water) in a sufficient amount to activate the adhesive thereby allowing the mixture to be blown adheringly into the space to be insulated and cured in situ without the need for netting or the like to contain it until it sets.

The term "R-value" is also a term well understood in the art and is used herein according to its well known meaning. In this respect, R-value of fibrous insulation is generally recognized as being defined and determinable by ASTM C 653 "Standard Guide for Determination of the Thermal Resistance of Low Density Blanket Type Mineral Fiber Insulation".

As illustrated in the Figures and more fully described below, a method and apparatus are provided for accurately and effectively installing blown-in-place insulation to a preselected thickness, density and R-value. The fibrous material employed may be any known fibrous insulation material, including fiberglass, rockwood, cellulose or the like. The adhesive employed may be selected from any operative fast setting adhesive, activated by a liquid, and the activating liquid may be one appropriate for the task.

In the preferred embodiments of this invention the admixture employed and the blowing technique used are those disclosed in the aforesaid U.S. Pat. Nos. 5,641,368 and 5,666,780, as well as the commercial embodiments thereof which employ loose-fill fiberglass and are known by the trade designation ULTRAFIT DS™ fiberglass spray-on system available from Guardian Fiberglass, Inc. of Albion, Mich.

In such a system for sidewall coverage wherein the approximate weights of the ingredients in the sprayed admixture consist essentially of 79% virgin unbonded fiberglass approximately 3–4 microns in diameter and approximately ¼ in. in length, 1% AIRFLEX RP-140 or 2017 redispersible vinyl acetate-ethylene copolymer powder adhesive, and 20% tap water/moisture employing a spraying pressure of about 100–150 psi, the following correlation between R-value, thickness and density generally applies:

TABLE 1

| Nominal R-Value | Insulation Thickness (Inches) | Wall Stud Dimension (Inches) | Density (lbs./ft.$^3$) |
|---|---|---|---|
| R 14 | 3.5 | 2 × 4 | 2.0 |
| R 22 | 5.5 | 2 × 6 | 2.0 |
| R 29 | 7.25 | 2 × 8 | 2.0 |
| R 37 | 9.25 | 2 × 10 | 2.0 |
| R 15 | 3.5 | 2 × 4 | 2.5 |
| R 23 | 5.5 | 2 × 6 | 2.5 |
| R 31 | 7.25 | 2 × 8 | 2.5 |
| R 39 | 9.25 | 2 × 10 | 2.5 |

Referencing now the Figures, container 1 includes an insulation receiving area 2 and is mounted in a yet to be insulated open wall cavity 5. As further illustrated particularly in FIG. 1, there is provided a typical residential wall structure 7 approximately 8 feel tall comprised of multiple cavities 5 as defined by back wall 32, vertical studs 17 and horizontal studs 19. The studs are conventional nominal 2"×4", 6"×8" or 10" studs with the vertical studs being separated 16 inches, center to center.

Cavity 5 is filled with insulation by blowing the loose-fill insulation admixture into the cavity while, at the same time, filling insulation receiving area 2 of open box or tray (i.e. container) 1 with insulation. Cavity 5 need not be filled completely and, indeed, only container 1 need be filled at this time, if desired. However, in practice, it may be appropriate, starting either at the top or bottom (as illustrated at 16 in FIG. 1), to fill most or all of cavity 5 because filling a conventional cavity 5 may often become a time dependent matter of art such that a rather close approximation or even the exact density desired may be determined by the skilled artisan who, through experience, learns the fill time of, for example, a standard studded wall cavity as shown in FIG. 1 at a given density and velocity (determined by blowing pressure).

After cavity 5 and container 1 have been filled with insulation as described in, for example, U.S. Pat. Nos. 5,666,780 and 5,641,368, and excess loose-fill insulation is scrubbed off in a known manner, the filled-up container 1 is removed from the cavity and weighed. From its known weight and volume and the fill weight, density is easily determined (i.e. fill weight minus known weight divided by known volume=the density).

By making container 1 large enough (e.g. at least about 10% or more of the volume of the entire cavity or space between two vertical studs to be filled) a sufficiently large sample of the in situ formed insulation is obtained so that multiple samples need not be made for reasonable accuracy. For example, in certain embodiments of this invention, the box or tray (i.e. container 1) may have a volume of about 0.4–0.5 ft.$^3$. Container 1 may, in certain embodiments, be about 3.5 inches deep (to match the 2"×4" studs) and about 14.5 inches in height. If the wall studs are spaced 16" on center, container 1 may be a square, i.e. 14.5 inches per side. This results in a container of about 0.4–0.5 ft$^3$. Different sized boxes or trays 1 may be provided for use in, for example, 2"×6" stud wall cavities and for use in 2"×8" or 2"×10" stud wall cavities. In attic applications, the volume of the box or tray may be about one cubic foot in certain embodiments. In each instance container 1 should be sufficiently large so as to constitute a representative sample of the filled area so that, in reality, multiple samples for a given space need not be taken or minimized in number to achieve reasonable assurance that the desired density has been achieved.

In a typical operation, a loose-fill mixture of (i) fiberglass, and (ii) an inorganic dry adhesive in the form of a redispersible powder or the like, is blown or sprayed together with an activating liquid (e.g. water) into a cavity to be insulated. Liquid applied to the mixture during blowing/spraying activates the dry adhesive so that when the insulating mixture reaches the cavity it is retained, or sticks, as is well known in the art and as described below. In such a manner, it is ensured that the proper adhesive amount is present in the product. Thus, the user needs only to add an activating liquid such as water to the mixture at the job site in order to achieve a premium residential insulation product which yields high, predetermined R-values and cost effective densities, together with uniform and consistent applications and noise abatement.

FIG. 1 is a perspective view of the admixture being wetted with an activating liquid (e.g. water) and thereafter blown into vertically extending open cavity 5 which has container 1 mounted therein. As shown in FIG. 1, user 3 is provided with dry mix blow hose 11 and activating liquid supply hose 13. At nozzle area 15, the loose-fill/dry adhesive mixture blown from hose 11 is coated or wetted with the activating liquid (e.g. water) from hose 13 and thereafter sprayed/blown into open cavity 5 whose pressure (velocity) is adjustable using known conventional equipment. The dry adhesive in the mixture supplied through hose 11 is activated when wetted with the liquid from hose 13. Concurrently with activation of the adhesive, the wet activating mixture is blown into cavity 5 and into the insulation receiving area 2 of container 1. The nozzle is normally held 18"–24" from the cavity to be insulated when the aforesaid known ULTRAFIT DS™ system is used. The sprayed insulation mixture with activated adhesive adheres to or sticks to wall 32 which may be made of plywood, CELOTEX™, or any other known residential exterior insulating sheeting, and also sticks to wall studs 17 and 19 and the side and rear walls of container 1. No netting or other supporting structure is needed to retain the sprayed on mixture in open cavity 5 or container 1.

Each cavity is, as illustrated, bounded on either side by vertical studs 17 and on the top and bottom by horizontal studs 19. These studs may be, for example, 2"×4", 2"×6", 2"×8", or 2"×10", as known in the trade. Open cavities 9 and 10 in FIG. 1 have been filled with the spray-on insulation, their density determined and achieved according to this invention, while open cavities 21 have not (open cavity 5 is in the process of being filled). Container 1 has sidewalls whose depth matches the depth dimension of the wall studs (taking into account the thin back wall of container 1) and is mounted into a noninsulated cavity 5, prior to insulation, at a central location therein. It is understood, of course, that FIG. 1 is an illustrative embodiment. In other embodiments, once the preselected density is achieved by this invention in open cavity 9, the remaining cavities can then be filled with confidence unless, for example, new bags of loose-fill are needed or other parameters are changed which necessitate a new density determination.

Dry loose-fill blower 23 is attached to hose 11 and may be, for example, a commercially available pneumatic blower which works in conjunction with liquid pump 25 capable of about two gallons per minute at 200 psi (although about 100 psi, for example, may be used during application of the product). The use of the term "velocity" herein refers to this parameter, i.e. gallons per minute at a given psi, a parameter adjusted by varying the pressure.

Blower 23 functions to blow the loose-fill inorganic fiber/adhesive combination through hose 11 to nozzle area 15 where the adhesive is activated by the liquid from hose 13. The liquid is pumped through hose 13 by way of pump 25 as discussed above and its amount may be adjusted in a conventional way. The liquid from hose 13 coats the fiberglass and activates the adhesive, and also acts to retain the dampened mixture in cavity 5 and area 2 during spraying, while the activated adhesive functions to hold the fiber in cavity 5 and area 2 after curing and provides desirable integrity.

After container 1 has been filled with the insulating mixture, the user may use an electric scrubber to shave off excess fiber from it and any portion of the cavity 5 filled in the process. As illustrated in FIG. 1, the operator has started from the bottom and worked upwardly. In other embodiments he may wish to start from the top and work down. Some or all of the cavity 5 may be filled. Complete filling may be done, for example, as a timing technique, as aforesaid, which experience has previously dictated is the time of fill if a proper admixture, velocity and thus density is achieved (or needs to be varied due to a too fast or slow fill time).

In finishing off the container and cavity 5 the user may start about 12" from the top of the cavity and proceed downward with the scrubber. Thereafter, the user may reverse the scrubber direction so that the roller is rotating upward instead of downward. The remainder of the overspray may then be shaved off by starting at the bottom and moving upward until the open face of the cavity has been completely cleaned. This technique helps reduce the possibility of fiber sagging at the tops of the cavities. After scrubbing, the user grips handle 35 of container 1 and pulls the container out of the now insulated cavity 5 (i.e. the filled-up and scrubbed container is removed from the cavity). At this time, of course, the container is filled with the same in situ formed insulation that has been or will be used to fill cavity 5. Thus, determining the density of the insulation in the container will also give the density of the insulation now filling or to fill cavity 5.

Alternatively, instead of handle 35, container 1 may include a substantially round-shaped eye hook for enabling a scale to be attached to the container after removal in order to conveniently weigh the filled container after it has been removed from cavity 5. Container 1 need not be made of wall stud boards, but may be made of any convenient material, the parameters of interest being its unfilled weight and volume (of fill).

In order to measure the density of the insulation now filling up both cavity 5 and removed container 1, container 1 is weighed by the user. For example, a conventional digital scale may be attached to container 1 at its handle 35 so that container 1 hangs from the scale. In such a manner the scale indicates the weight of the insulation-filled container 1. Because the volume of the area 2 filled in with insulation is known, and because the non-filled or empty weight of container 1 is known, it is now possible for the user to easily determine the density of the insulation filling the weighed container. Subtracting the empty known weight of the container from its as weighed fill weight yields the weight of the insulation (e.g. in lbs.). Dividing this sum by the known volume of the container (e.g. $ft.^3$) gives the density of the insulation (e.g. $lbs./ft.^3$) as installed.

If, at this initial weighing, the density meets the predetermined, desired density, the hole left by removal of container 1 is simply filled by blowing the admixture therein under the same parameters of operation. Thereafter, thickness is checked using, for example, a conventional needle probe (and adjusted, if necessary), so as to be sure the desired thickness, and thus its correlated R-value, has been achieved.

If, on the other hand, the desired density has not been achieved, cavity 5 and container 1 are emptied, the necessary adjustments to one or more of the operating parameters, dictated by experience, are made, and the above process repeated until the correct density is achieved. The operating parameters capable of changing the density, and thus one or more of which may be adjusted, include: the relative amount of fiber to adhesive to water in the admixture (the ratio of fiber to adhesive, of course, normally being fixed, i.e. not adjustable, because premixed and bagged at the factory for quality control); the distance from the wall at which the nozzle is held; the velocity of the blowing operation; or a combination thereof.

Once the desired density is finally achieved, each cavity may then be filled to the prescribed thickness using the adjusted admixture parameters to achieve the requisite R-value. Normally, unless new bags of loose-fill fiber/adhesive are added, or some other parameter is materially changed, container 1 need not be used again, or will be used in only a few cavities later to assure uniformity in R-value. Measuring of thickness and timing of fill in progressively filled cavities of like size will usually be sufficient, in this respect, to indicate any undesirable possible density change that necessitates another use of container 1 to redetermine density. In short, by the use of the method and apparatus of this invention the amount of testing is kept at a minimum, while the quality and uniformity of the in situ formed insulation is maximized.

Figure 2:
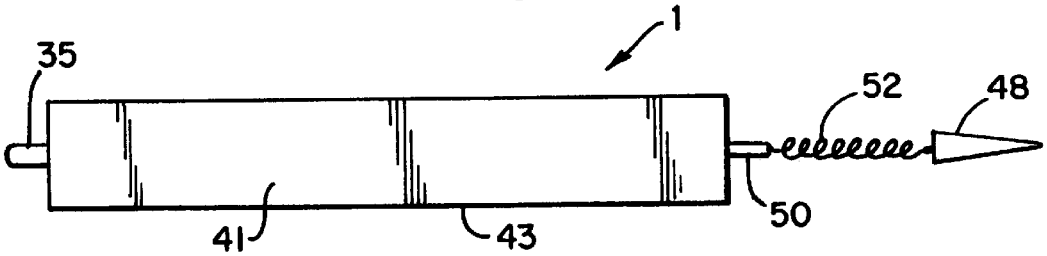
FIG. 2 is a side elevational view of the container of FIG. 1 adapted to be positioned within the confines of the wall cavity during insulation blowing.
Figure 3:
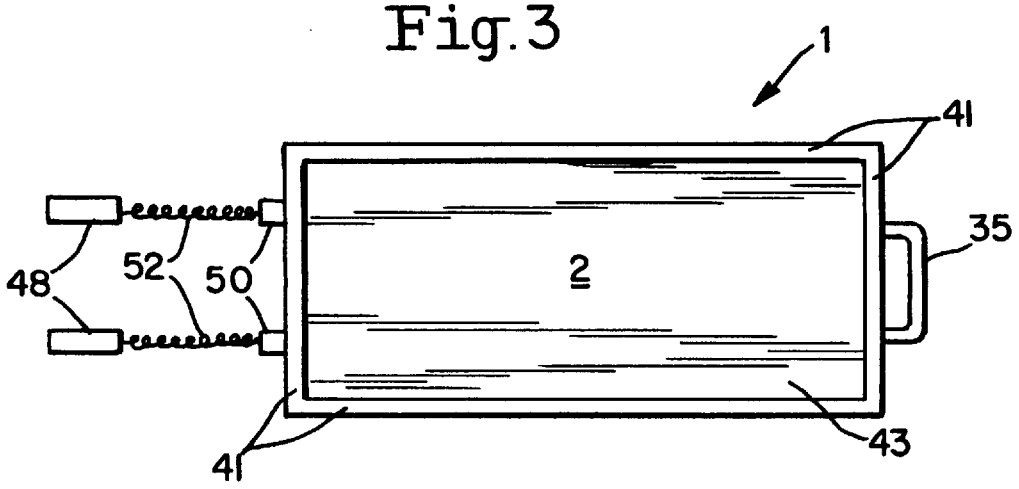
FIG. 3 is a top view of the box of FIGS. 1–2.

By way of a more detailed description of certain preferred embodiments of container 1, FIG. 2 is a side elevational view of one such embodiment of container 1, while FIG. 3 is a top view of the same container. Referring to these figures, it can be seen that container 1 includes an insulation receiving area 2 having a known volume. Area 2 in certain embodiments is defined peripherally by four sidewalls 41 and also by bottom wall 43. Container 1 is removably but rigidly mounted within cavity 5 to be insulated so that bottom wall 43 of the container is positioned closely adjacent the back wall 32 of the open cavity, thereby allowing the open side of area 2 to face the user and nozzle 15 so as to receive the blown insulation and fill up with same when the cavity is being insulated. As discussed above, container 1 (hereinafter referred to as tray/box 1) includes handle 35 in certain embodiments so as to enable the tray/box to easily be inserted and removed from cavities in an efficient manner.

Figure 4:
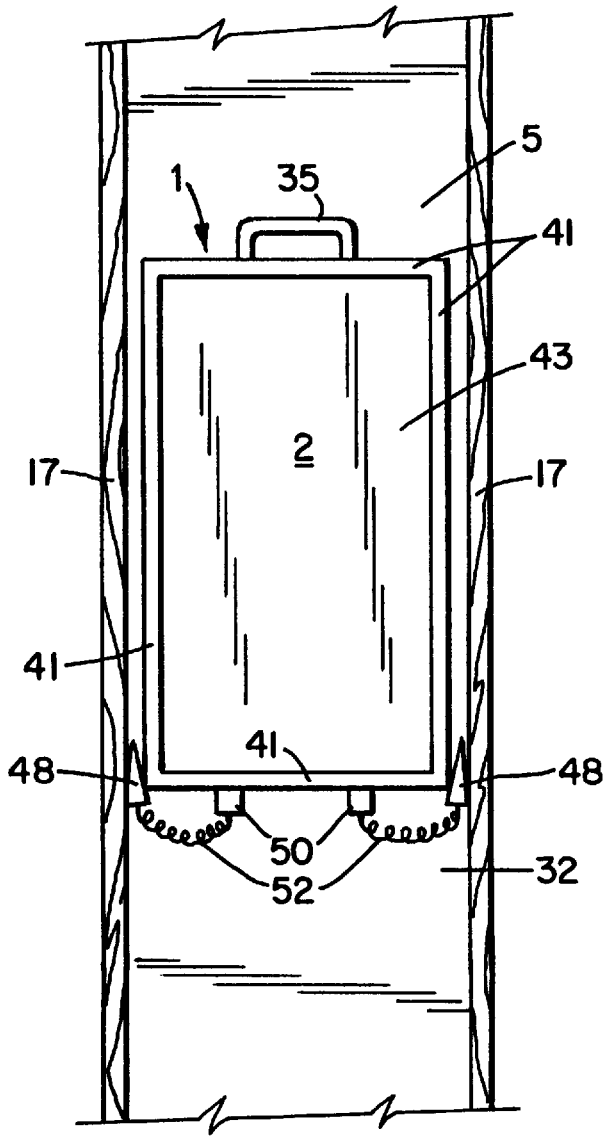
FIG. 4 is a front view of the vertically extending open wall cavity of FIG. 1.

FIG. 4 illustrates tray/box 1 of FIGS. 1–3 removably mounted within a non-insulated cavity in accordance with an embodiment of this invention. As illustrated, the tray/box is mounted between the two studs 17 defining the sidewalls of vertically extending open cavity 5. Bottom wall 43 of the tray/box is closely adjacent rear wall 32 of the cavity. The tray/box is removably mounted within the cavity by placing the tray/box within the cavity and then sliding a wedge 48 in between each vertically extending sidewall 41 of the tray/box and the adjacent stud 17 until the tray/box becomes rigidly positioned within the cavity. The weight of the tray/box causes the two wedges 48 to maintain their positions illustrated in FIG. 4, thereby holding the tray/box at a central location within the cavity and preventing it from falling out during insulation. Wedges 48 are attached to tray/box 1 by way of corresponding mounting members 50 and flexible attachment members 52 (e.g. link chain, string, wire, etc. It is understood, of course, that FIG. 4 could also illustrate a typical wall or floor structure of an attic. In the case of an attic floor, studs 17 therein would then be horizontal instead of vertical.

In certain embodiments it has been found that only one wedge 48 need be provided and used, and that this single wedge is sufficient to retain the box between adjacent studs. In certain other embodiments, a plurality of different sized wedges 48 may be provided on the end of each member 52 so as to enable the tray/box to be mounted into different size cavities (i.e. cavities having different widths). In preferred embodiments, the tray/box is sized so that its sidewalls 41 are substantially flush with the outside edges of the adjacent studs in order to facilitate simple and efficient scrubbing. In alternative embodiments, the sidewalls of the tray/box may be sized so that they extend to a position slightly interior of the outer edges of the adjacent studs when the tray/box is mounted in the cavity.

Still referring to FIG. 4, after the tray/box 1 is mounted therein as illustrated, the loose-fill insulation (e.g. fiberglass or cellulose) is blown into the cavity and tray/box as discussed above. After excess insulation is scrubbed off, the tray/box is removed from the cavity (e.g. the user can simply use the handle to lift the tray/box upward thereby dislodging it from the cavity and wedges) and weighed so as to measure the density of the insulation in both the tray/box and the cavity, all as described above.

EXAMPLE

The following example is presented as illustrative of an embodiment of this invention. Assume a typical residential wall to be filled with insulation as illustrated in FIG. 1. The following steps are then taken to initiate, carry out and complete the job:

When spraying is to start, hollow box 1 of known volume and weight is placed into one of the first two cavities to be filled, approximately half way up the wall. The box chosen has sides matching the size of the stud walls. Filling the cavity containing the box is begun using ULTRAFIT DS™ admixed with water at a pressure of about 100–150 psi, starting from bottom to top, making sure the box is filled. In a typical example, the cavity should take approximately 35 seconds to fill using an admixture by weight of 79% fiberglass, 1% adhesive, and 20% moisture/water. The fiber, as aforesaid, is a virgin, unbonded fiber approximately 3–4 microns in diameter and 0.25" avg. length. The water-activated adhesive is Air Products Inc.'s AIRFLEX RP 140 (or 2017) redispersible powder (a vinyl acetate-ethylene copolymer). Ordinary tap water with no particular temperature requirement is employed.

Given the aforesaid dimensions of the box typical parameters have been found to be as follows (using a 2×6 box for 2×6 framing and a 2×4 box for 2×4 framing, located in the cavity about 2–3 feet above the floor 99 and based on a 30% overspray with scrub off).

TABLE 2

(2 × 4 STUD FRAMING)

| TIME IN CAVITY | DESIRED DENSITY | SPRAYED BOX WEIGHT |
|---|---|---|
| | SPRAYING PRESSURE 100 psi | |
| 50 SECONDS | 2 lb. | 3 lb. 11 oz. |
| | 2.5 lb. | 3 lb. 15 oz. |
| 45 SECONDS | 2 lb. | 3 lb. 10 oz. |
| | 2.5 lb. | 3 lb. 14 oz |
| 40 SECONDS | 2 lb. | 3 lb. 9 oz. |
| | 2.5 lb. | 3 lb. 13 oz. |
| 35 SECONDS | 2 lb. | 3 lb. 8 oz. |
| | 2.5 lb. | 3 lb. 12 oz. |
| 30 SECONDS | 2 lb. | 3 lb. 7 oz. |
| | 2.5 lb. | 3 lb. 11 oz. |

TABLE 2-continued (2 × 4 STUD FRAMING)

| TIME IN CAVITY | DESIRED DENSITY | SPRAYED BOX WEIGHT |
|---|---|---|
| 25 SECONDS | 2 lb. | 3 lb. 6 oz. |
| | 2.5 lb. | 3 lb. 10 oz. |
| | SPRAYING PRESSURE 150 psi | |
| 50 SECONDS | 2 lb. | 3 lb. 12 oz. |
| | 2.5 lb. | 3 lb. 16 oz. |
| 45 SECONDS | 2 lb. | 3 lb. 11 oz. |
| | 2.5 lb. | 3 lb. 16 oz. |
| 40 SECONDS | 2 lb. | 3 lb. 10 oz. |
| | 2.5 lb. | 3 lb. 14 oz. |
| 35 SECONDS | 2 lb. | 3 lb. 9 oz. |
| | 2.5 lb. | 3 lb. 13 oz. |
| 30 SECONDS | 2 lb. | 3 lb. 8 oz. |
| | 2.5 lb. | 3 lb. 12 oz. |
| 25 SECONDS | 2 lb. | 3 lb. 7 oz. |
| | 2.5 lb. | 3 lb. 11 oz. |

TABLE 3

(2 × 6 STUD FRAMING)

| TIME IN CAVITY | DESIRED DENSITY (ft.$^3$) | SPRAYED BOX WEIGHT |
|---|---|---|
| | SPRAYING PRESSURE 100 psi | |
| 75 SECONDS | 2 lb. | 3 lb. 7 oz. |
| | 2.5 lb. | 3 lb. 11 oz. |
| 67.5 SECONDS | 2 lb. | 3 lb. 6 oz. |
| | 2.5 lb. | 3 lb. 10 oz. |
| 60 SECONDS | 2 lb. | 3 lb. 5 oz. |
| | 2.5 lb. | 3 lb. 9 oz. |
| 52.5 SECONDS | 2 lb. | 3 lb. 4 oz. |
| | 2.5 lb. | 3 lb. 8 oz. |
| 45 SECONDS | 2 lb. | 3 lb. 3 oz. |
| | 2.5 lb. | 3 lb. 7 oz. |
| | SPRAYING PRESSURE 150 psi | |
| 75 SECONDS | 2 lb. | 3 lb. 8 oz. |
| | 2.5 lb. | 3 lb. 12 oz. |
| 67.5 SECONDS | 2 lb. | 3 lb. 7 oz. |
| | 2.5 lb. | 3 lb. 11 oz. |
| 60 SECONDS | 2 lb. | 3 lb. 8 oz. |
| | 2.5 lb. | 3 lb. 10 oz. |
| 52.5 SECONDS | 2 lb. | 3 lb. 5 oz. |
| | 2.5 lb. | 3 lb. 9 oz. |
| 45 SECONDS | 2 lb. | 3 lb. 4 oz. |
| | 2.5 lb. | 3 lb. 8 oz. |

After this spraying is completed, the area is scrubbed (including the box area) and the box is removed from the wall and weighed. A guideline chart may be developed to determine approximate time of fill, as aforesaid, to achieve a desired density, e.g. 35 seconds to achieve a density of 2.5 lb./ft.$^3$ with box weight of 3 lb. 13 oz.

If the density measured does not meet the predesignated density, the box and cavity(s) so filled are cleaned out and the appropriate adjustment to one or more of the operating parameters made as follows. For example:

If the box is too heavy, spraying may have been done too close to the wall, or the air and/or water pressure in the fiber blower may be reduced to reduce velocity, or fiber content may be reduced by adjusting the feeder gate (not shown) on blower 23.

If the box is too light, the reverse of the above adjustments may be made. In short, admixture ratios, velocity and impact by distance from wall can be adjusted to vary the density. Similar adjustments can be made for attic insulation.

However, distance from floor is usually not a truly viable adjustable parameter in attics or close crawl spaces.

In either event, the appropriate adjustments are made and the test wall cavity is again refilled one or more times until the required density is achieved. Thereafter the hole left by the box is filled in (and, of course, the cavity filled to the prescribed thickness). The remaining wall cavities are then filled using the same adjusted parameters and, as a check, the fill time and thickness measurement used so that only an occasional reuse of the box when desired, or necessitated by a suspected change in density, is done. As aforesaid, the density chosen is usually for the desired R-value as set forth in TABLE 1 above.

Once given the above disclosure, many other features, modifications, and improvements will become apparent to the skilled artisan. Such other features, modifications, and improvements are therefore considered to be a part of this invention, the scope of which is to be determined by the following claims.

I claim:

1. A method for installing blown-in-place insulation at a prescribed density and thickness, the method comprising:

providing a volume of space to be filled with said blown-in-place insulation;

preselecting a density of said blown-in-place insulation when formed in situ in said space;

locating within said space a container of known weight and volume;

blowing at a given velocity and from a distance into at least a portion of said space to be filled, which portion of said space has said container located therein, a sufficient amount of an admixture comprising a fibrous insulation material, a fast setting liquid-activated adhesive and a liquid in an amount sufficient to activate said adhesive, to form in said container an in situ amount of insulation which fills said known volume of said container;

removing said container from said space and weighing said container filled with said in situ formed insulation;

determining the density of the in situ formed insulation from the known weight and volume of the container and the as weighed weight of the filled container; and comparing said preselected density to said determined density of said in situ formed insulation.

2. A method according to claim 1 wherein said volume of said container is at least 10% of the volume of the said space to be filled with said insulation.

3. A method according to claim 1 wherein said admixture comprises by weight 79% fiberglass, 1% adhesive, and 20% moisture and water, and wherein said blowing of said admixture is conducted by a nozzle held between about 18–24 inches from the space to be filled, and said pressure of said water when admixed and blown is about 100–150 psi.

4. A method according to claim 1 wherein said space to be filled is a portion of a floor of an attic in a residential dwelling.

5. A method according to claim 1 which, after said comparison of said preselected density to said determined density, includes the step of:

further blowing an admixture of said fibrous insulation material, said fast setting liquid-activated adhesive and said liquid in an amount sufficient to activate said adhesive, in response to said comparison of said preselected density to said determined density thereby to form in said space, insulation having said preselected density.

6. A method according to claim 5 which further includes the step of:

preselecting a thickness of said blown-in-place insulation;

determining from said preselected density and said preselected thickness a preselected R-value; and blowing said admixture in response to said comparison to form blown-in-place insulation having said preselected R-value.

7. A method according to claim 6 wherein said preselected density and thickness result in an R-value of said insulation as installed of between R-14 to R-39.

8. A method according to claim 7 wherein said preselected density is 2.0–2.5 lbs./ft.$^3$ and said preselected thickness is between 3.5–9.25 inches.

9. A method according to claim 1 wherein said space to be filled is a space between opposing vertical studs in a wall of a dwelling.

10. A method according to claim 9 wherein said container is a rectangular box having a rear wall and sidewalls which are of the same depth dimension as said opposing vertical studs.

11. A method according to claim 10 which includes the steps of:

providing at least one wedge, locating said box between said opposing vertical studs, and securing said box in said location by wedgingly placing said at least one wedge between a respective sidewall and its opposing vertical stud located adjacent thereto.

12. A method according to claim 1 wherein the determined density when compared to said preselected density is different from said preselected density, the method further including the steps of: adjusting at least one operating parameter to change the density of the insulation when formed in said space so as to be the same as said preselected density and thereafter blowing said admixture into said space to fill at least a portion of said space with insulation having said preselected density.

13. A method according to claim 12 wherein said adjusting step includes adjusting at least one operating parameter selected from (a) the relative amount of fiber to adhesive to water in said admixture, (b) the velocity of blowing of the admixture, or (c) the distance from the space at which the insulation is blown.

14. A method according to claim 12 which further includes the steps of preselecting a thickness of said blown-in-place insulation; determining from said preselected density and said preselected thickness a preselected R-value; and wherein said blowing of said admixture into said space using said at least one adjusted operating parameter fills said space with insulation having said preselected R-value.

15. In combination, a wall or floor of a dwelling having at least one cavity therein for receiving blown-in-place insulation, said cavity being defined by spaced first and second studs, and a device for determining the density of blown-in-place insulation installed in said cavity, said device including:

a container of known weight having four sidewall portions and a rear wall defining thereby a chamber having a preselected volume for receiving said blown-in-place insulation, wherein said container is filled with said blown-in-place insulation to its preselected volume, and a wedge member, said wedge member wedgingly securing said container within said cavity between said first and said second studs.

16. The combination of claim 15 wherein said sidewall portions of said container are of the same depth as said adjacent studs.

17. The combination of claim 15 wherein the volume of said container chamber is at least 10% of the volume of the cavity between said first and second studs.

18. A device for determining the density of blown-in-place insulation installed in an open cavity between spaced first and second wall or floor studs in the wall or floor of a dwelling, said device including:

a container of known weight having four sidewall portions and a rear wall defining thereby a chamber of a preselected volume for receiving said blown-in-place insulation, and a pair of wedge members for wedgingly retaining said container between said sidewall portions and a respective stud of said cavity adjacent thereto.

19. A device according to claim 18 wherein each of said wedge members is attached to said container by a flexible member.

20. A device according to claim 18 wherein said container is provided with handle means for removing said container from a cavity.

* * * * *